US006781499B2

(12) United States Patent
Steiner

(10) Patent No.: US 6,781,499 B2
(45) Date of Patent: Aug. 24, 2004

(54) INDUCTIVE COMPONENT WITH WIRE-GUIDING SLOTS

(75) Inventor: Eva Steiner, Hohenlinden (DE)

(73) Assignee: EPCOS AG (DE)

( * ) Notice: Subject to any disclaimer, the term of this patent is extended or adjusted under 35 U.S.C. 154(b) by 0 days.

(21) Appl. No.: 10/472,428

(22) PCT Filed: Mar. 20, 2002

(86) PCT No.: PCT/DE02/01010

§ 371 (c)(1),
(2), (4) Date: Feb. 11, 2004

(87) PCT Pub. No.: WO02/078016

PCT Pub. Date: Oct. 3, 2002

(65) Prior Publication Data

US 2004/0119575 A1 Jun. 24, 2004

(30) Foreign Application Priority Data

Mar. 23, 2001 (DE) ..... 101 14 182

(51) Int. Cl.[7] ..... H01F 27/30
(52) U.S. Cl. ..... 336/192; 336/208; 336/198
(58) Field of Search ..... 336/198, 208, 336/192, 83

(56) References Cited

U.S. PATENT DOCUMENTS

| | | | | |
|---|---|---|---|---|
| 4,166,265 A | * | 8/1979 | Reynolds et al. | 336/192 |
| 4,617,543 A | | 10/1986 | Akachi et al. | |
| 4,716,394 A | * | 12/1987 | Gordon | 336/192 |
| 4,904,975 A | * | 2/1990 | Medenbach | 336/192 |
| 5,008,644 A | | 4/1991 | Cooper | |
| 6,069,550 A | | 5/2000 | Huang | |
| 6,191,677 B1 | | 2/2001 | Orben et al. | |

FOREIGN PATENT DOCUMENTS

| | | |
|---|---|---|
| DE | 1 539 679 | 8/1969 |
| DE | 42 20 287 | 11/1994 |
| DE | 198 29 505 | 1/2000 |
| EP | 0 594 031 | 10/1993 |

* cited by examiner

*Primary Examiner*—Anh Mai
(74) *Attorney, Agent, or Firm*—Fish & Richardson

(57) ABSTRACT

An inductive component includes a coil body having an exterior flange and a winding tube, a contact strip on the exterior flange, the contact strip having contact elements, and a wire guide slot formed into the contact strip. In a first region, the wire guide slot is substantially perpendicular to the exterior flange. In a second region, the wire guide slot is angled toward the winding tube relative to the first region.

20 Claims, 3 Drawing Sheets

INDUCTIVE COMPONENT WITH WIRE-GUIDING SLOTS

FIELD OF THE INVENTION

The invention relates to an inductive component with a coil body which features a coil space delimited by an exterior flange and a winding tube, which features contact strips molded onto the exterior flange, and which has contact elements and wire guide slots which progress into the contact strips.

BACKGROUND

A coil of this nature is essentially known from European Patent Specification EP 0 594 031. These inductive components, primarily in the form of coils or repeaters, also featuring subdivided coil spaces, must satisfy elevated demands for surge voltage resistance and creep resistance. During the assembly of circuit boards with other electronic components, voltages of 200 V or more can occur between the coils. Consequently, it is necessary to wrap the coil body in such a way that buckling and bending stress exerted on the coil wire is as low as possible and that the coil itself is as uniform as possible. A uniform coil structure can also be necessary to satisfy electrical specifications for inductance. The relevant standards, such as EN60950 which applies to telecommunications applications and calls for creep resistance, must be observed in the respective specific applications of such coils or repeaters.

The coil ends, which must be connected to the contact elements, can be guided in the contact strips through wire guide slots. In practice, the first and each successive coil is attached to the inner surface of the flange with adhesive tape (barrier tape) and separated from the respective adjacent coil, so as to ensure creep resistance between the core and the first coil, on the one hand, and among the coils themselves, on the other hand. However, tension is exerted on the first coil and/or the inner coils as soon as the second coil and each ensuing coil is applied during production of the inductive component.

SUMMARY

Therefore, the object of the invention is to specify an inductive component of the type mentioned initially, but with improved properties.

In the invention, this object is solved by the features of claim 1. Embodiments of the invention are characterized in subclaims.

An advantage of the invention is that the segment of the wire of the first coil that progresses away from the winding tube and toward the contact elements and/or the take-up pins of the contact elements has no or only minor frictional contact with the second or higher coil, thus resulting in lower tensile stress on the coil wire. This applies analogously to the ensuing coils, i.e., to the second coil when the third is applied, etc., if more than two coils are provided. The greatest advantage, however, arises with the first, innermost coil, because the distance between it and the contact strip is greatest.

Another advantage comprises the fact that the accuracy of the coiling process is increased during production of the component.

Advantageously, the barrier tape can be easily and securely applied laterally to the inside of an exterior flange because the coiling wire in this region is, for the most part, disposed in the wire guide slot and is at best only slightly disposed on the inside of the exterior flange.

Another advantage of the invention comprises the fact that, due to the progression of the terminal portion of the coil wire within the wire guide slots, the homogeneity of the layer structure of the coils is significantly improved, especially in higher coil layers. This makes it possible to design the inductive component as a surface-mountable component and, due to the homogeneous coil structure, to automate the configuration process (pick and place). At the same time, the coiling process of the inductive component can be managed in an accurately controlled manner.

An advantage of the invention comprises the fact that, because of the low buckling and bending stress exerted on the coil wire in the connection zones and because of the fact that the wire is guided through the wire guide slots, the surge voltage resistance and creep resistance of the component are improved.

In the following, the invention is explained in greater detail on the basis of four figures, in which identical elements are identified with the same reference numbers. Shown are in

DETAILED DESCRIPTION

Figure 1:
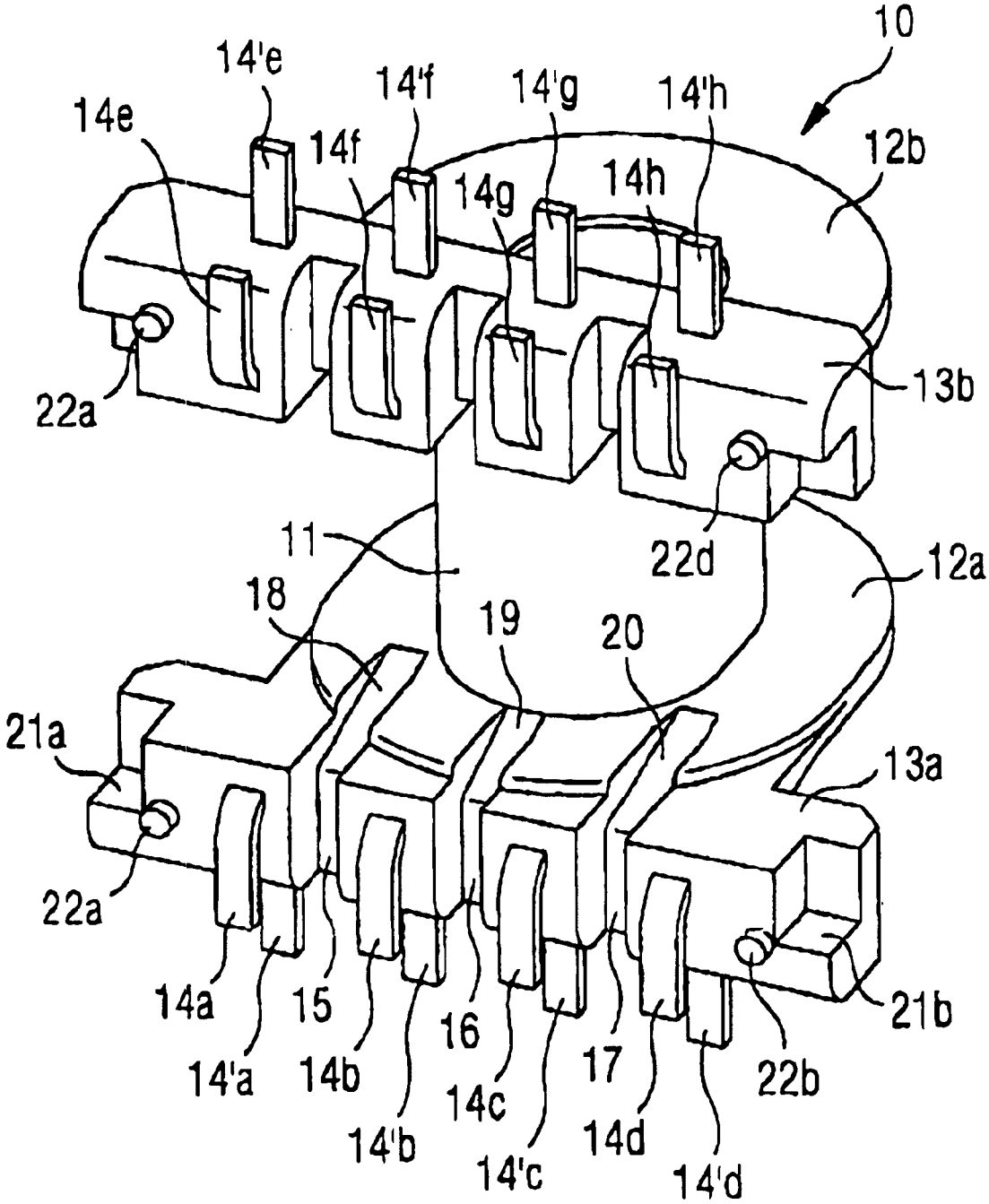
FIG. 1 schematically, an exploded view of a coil body according to the invention, FIG. 2, a section through the coil body perpendicular to the axis of the winding tube, FIG. 3, another schematic exploded view of the coil body according to the invention, FIG. 4, schematic cross-sections of various forms of wire guide slots, and FIG. 5, a schematic view through a terminal portion of the coil wire

A surface-mountable inductive element is depicted in the exemplary embodiment of FIG. 1. According to FIG. 1, in which elements of the component, in the interest of symmetry and to improve comprehensibility, reference numbers are provided on only one side of the winding tube. An exploded view of the component is depicted as viewed from below, i.e., the view of the base to be attached to a circuit board at a later point. The inductive component is, in particular, a coil or a repeater, and can also comprise subdivisions of the coil space.

The coil body 10 features a coil space, which, in the exemplary embodiment, is not subdivided. The coil space is defined by a winding tube 11, which, in the exemplary embodiment, is virtually ellipsoid, although it can also possess a different cross-sectional shape, such as circular. The coil space and/or the winding tube is laterally delimited by exterior flanges 12*a*, 12*b*. Contact strips 13*a*, 13*b* are molded in one piece to the exterior flanges 12*a*, 12*b*. Each of the contact strips contains contact elements which, in the exemplary embodiment, are rod-shaped and, at one end, are connected to the ends of the coils by take-up pins 14'*a* to 14'*h* and, at the other end, can be connected to corresponding contact surfaces through circuit board pins 14*a* to 14*h*, such as on a printed circuit board.

Of course, the contact strips can also have other forms of connecting elements, such as those known in the art for surface-mountable components. The geometry of the electric connecting elements of the coil body is largely independent of the design of the wire guide slots.

The parts of the contact elements protruding from the underside of the contact strips, the circuit board pins, are shaped such that the connecting contact portions of the contact elements are bent and flattened. The flattened undersides of the circuit board pins are disposed to be coplanar, so that the component can be easily placed onto a printed circuit board and soldered. In the exemplary embodiment, these areas are disposed in a plane that progresses in parallel to the axis A (see FIG. 2) of the winding tube.

To facilitate bonding of the coil, the contact elements are guided within the contact strips such that a second of each contact element, the take-up pin, protrudes laterally from the coil body. These ends of the contact elements, which are provided for coil bonding purposes, are also disposed essentially in a plane parallel to the axis of the winding tube. This embodiment of the contact elements also offers the opportunity to gain access to the coil connections, even if the component is soldered to a circuit board. However, the component can also be designed with push-through contact elements or other geometric configurations of the contact elements.

On each side of the coil space, several wire guide slots are disposed between the contact elements. In the exemplary embodiment, the wire guide slots 15, 16 and 17 between the contact elements 14*a* to 14*d* —or corresponding wire guide slots on the other side of the coil space—are disposed on the undersides of the contact strips at right angles to the longitudinal axis of the contact strips of the coil body.

The wire guide slots, which initially progress within the contact strips essentially in parallel to the axis A of the winding tube, then bend in the direction of the coil space and the winding tube. "In the direction of" signifies that the depth of the respective wire guide slot is reduced toward the winding tube, and finally turns to zero on the inside of the exterior flange. In the exemplary embodiment, the bending point is so far from the inner edge of the contact strips or the inside of the exterior flange as to result in a slanted area, which can completely enclose the coil wire disposed therein without requiring that the wire be bent excessively at the bending point of the wire guide slot.

Instead of a comparatively strong bend, as shown in FIG. 1 and illustrated again schematically in FIG. 4*a* as a step through a contact strip, other geometric forms of the progression of the wire guide slot on the side facing the inside of the exterior flanges can be provided. The cross-section of the wire guide slot in FIG. 4*b* is continuously bent or curved, while FIG. 4*c* shows a continuous diagonal of the cross-section relative to the axis of the winding tube 11. In FIG. 4*c*, the exterior flange 12 is thickened in the area of the transition to the contact strip 13 at the level of the wire guide slot, identified by reference number 24. The geometric dimensions are designed so as to ensure that there are no sharp edges that could damage the insulation of the wire coil to be applied.

Figure 2:
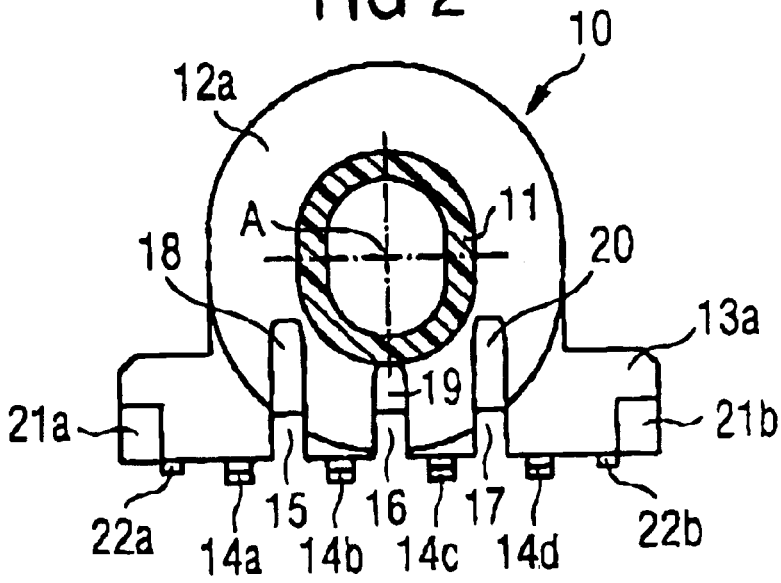
Figure 4:
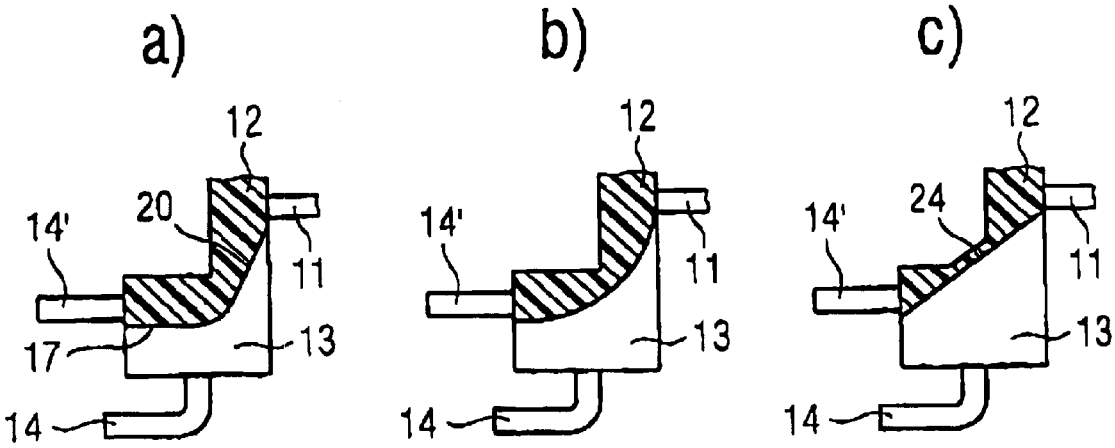

In FIG. 1, the slanted segment 18 and 20 of each wire guide slot —or corresponding areas on the other side of the coil space—, as is evident in FIG. 2 or FIG. 4, feeds into the inside of the respective exterior flange in proximity to the winding tube 11, while the corresponding segments 19 of the central wire guide slot feed into the coil space while still in the area of the contact strip (see FIG. 2). This means that, since a rectangular cross-section of the wire guide slot was selected in the exemplary embodiment, the wire guide slots feed into the exterior region of the coil body with one corner contacting or immediately adjacent to the winding tube, e.g., at a distance from it of less than the width of one slot. Other cross-sections and courses of the wire guide slots are possible, such as a trapezoid or oval cross-section. Moreover, the external wire guide slots 15, 17 must not be symmetrical to the wire guide slot 16. Only the centrally disposed wire guide slot 16 feeds with essentially its entire cross-sectional width into the winding tube. This also means that the inside surfaces of the exterior wire guide slots can connect to the winding tube tangentially at best or that they are advantageously oriented toward the winding tube. If necessary, the longitudinal direction of the areas 18 and 20 can, instead of being parallel to the axis A of the winding tube, progress at an angle to it or, in extreme cases, directly toward it.

The necessary number of wire guide slots depends on the number of contact elements and, at each contact strip, is reduced by one relative to the contact elements.

Figure 3:
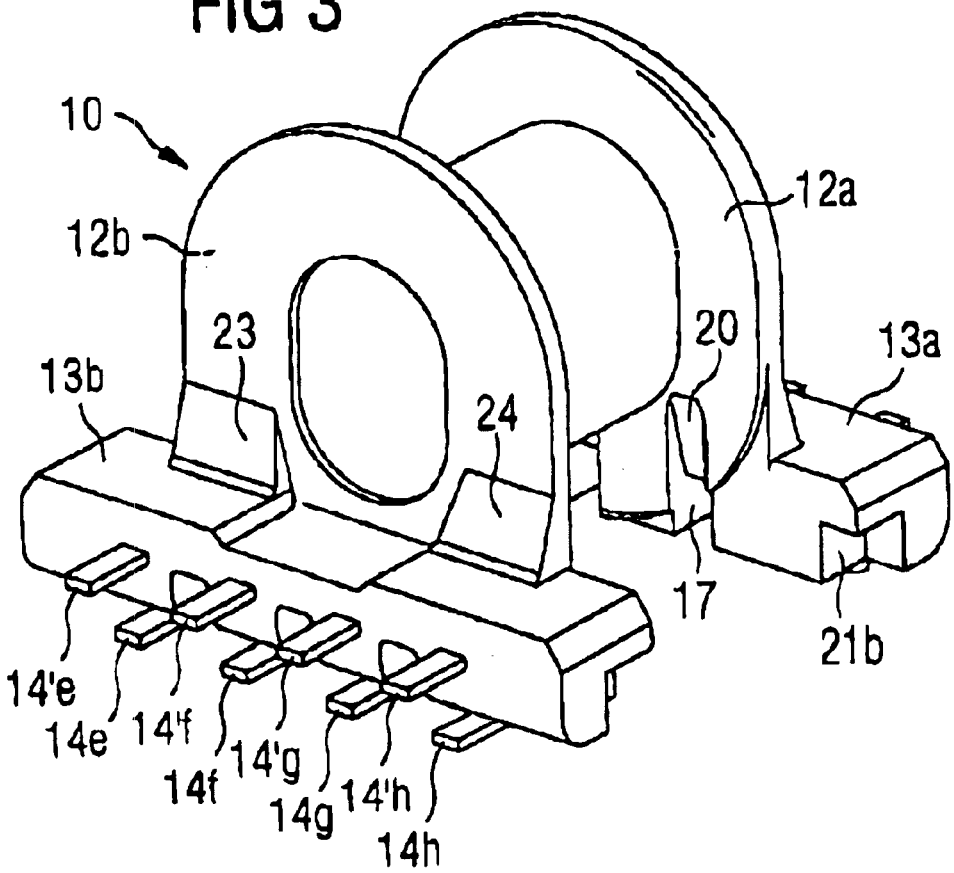

According to the invention, the slanted areas 18 and 20 of the wire guide slots no longer progress exclusively in the contact strips, but at least partially in the exterior flanges. To prevent excessive weakening of the material of the exterior flanges in the area of the wire guide slots progressing in the direction of the winding tube, it can be provided that the exterior flanges are additionally reinforced, at least in the area outside the coil space, as schematically in FIG. 3 and FIG. 4*c*. In this case, the exterior flanges feature, in the area of transition to the contact strips, a base reinforcement 23, 24 that tapers in the direction of the axis of the winding tube. This reinforcement also makes it possible to essentially guarantee greater stability between the exterior flanges and the contact strips. In small components, this has a positive impact on the coplanar relationship between the contact element connection areas and the circuit board. Conversely, this significantly reduces the risk of a predetermined breaking point between the exterior flange and the contact strip.

Figure 5:
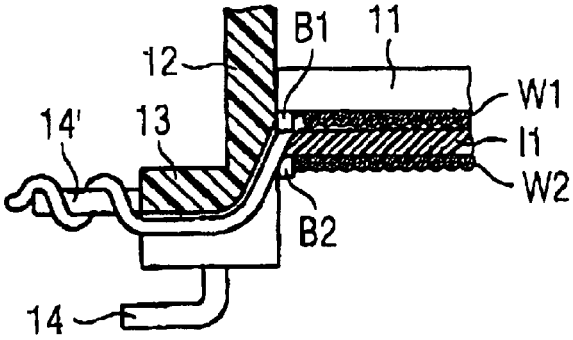

Due to the slanted design of the wire guide slots in the inside portion of the exterior flanges, it is possible to already connect the connecting portion of the lowest coil with the take-up pins, even if soldering has not yet taken place. In this case, the wire connecting portion is disposed essentially within the wire guide slot reaches the coil space almost directly at the winding tube, such that it is at best only slightly disposed on the exterior flanges at right angles to the coiling direction. This is indicated schematically in FIG. 5, wherein coils W1 and W2 are provided, each fastened to the exterior flange 12 with barrier tape B1 or B2 and insulated against one another with an insulating layer I1.

Because the wire connector for the coil W1 is essentially disposed in the wire guide slot, the second or ensuing coils can exert no or only reduced tension on the lowermost coil W1, thereby producing the additional effect of removing stress on the wire connector. This also makes it possible to provide the coils with a highly homogeneous structure, since the wire connectors do not cause any significant bulges in the coil part. As a result of this homogeneous coil, it becomes possible to make a surface-mountable component "pick-and-place"-able, i.e., to enable this component to be picked up by a suction gripper and placed onto the circuit board.

Depending on whether the slanted portions of the wire guide slots are disposed closer to the center or the outer zones of the coil space, these slanted or ramp-shaped portions 18, 19, 20 have different lengths and different angles of incline, since this is the only means of ensuring that the slanted portions can run into the respective inside of the exterior flange in proximity to the winding tube.

The figures also depict undercuts 21*a*, 21*b* in the contact strips, to which, for example, a lid to be placed over the component can be secured. The lid is preferably made from an elastic material and features indentations along the edges of its rim which can engage the undercuts 21.

In the exemplary embodiment, pins 22*a*, 22*b* are also provided on the contact strips on the undersides of the inductive component, with said pins being used to help position the component on the circuit board. This, however, is a purely optional embodiment, since the component is also serviceable without the pins.

What is claimed is:

1. An inductive component, comprising:

a coil body comprised of an exterior flange and a winding tube;

a contact strip on the exterior flange, the contact strip having contact elements; and a wire guide slot formed into the contact strip;

wherein (i) in a first region, the wire guide slot is substantially perpendicular to the exterior flange, and (ii) in a second region, the wire guide slot is angled toward the winding tube relative to the first region.

2. The inductive component according to claim 1, wherein in the first region, the wire guide slot is substantially parallel to a longitudinal axis of the winding tube.

3. The inductive component according to claim 1, wherein in the second region, the wire guide slot bends towards a coil space in the coil body.

4. The inductive component according to claim 1, wherein portions of the wire guide slot in the first and the second regions form approximately a same angle to a longitudinal axis of the winding tube.

5. The inductive component according to claim 1, further comprising plural wire guide slots, wherein planes formed by the plural wire guide slots are parallel.

6. The inductive component according to claim 5, wherein a longitudinal axis of the winding tube is parallel to the planes formed by the wire guide slots.

7. The inductive component according to claim 1, further comprising plural wire guide slots, at least two of the plural wire guide slots being angled differently toward the winding tube relative to the first region.

8. The inductive component according to claim 1, wherein the wire guide slot has a cross section that is one of rectangular, trapezoidal, and oval.

9. The inductive component according to claim 1, wherein the wire guide slot is disposed between two contact elements.

10. The inductive component according to claim 1, wherein the contact strip comprises undercuts in terminal regions of the inductive component.

11. The inductive component according to claim 1, wherein the contact elements are parallel to an assembly plane of the inductive component.

12. The inductive component according to claim 1, wherein the contact elements are shaped such that a connecting area on a circuit board side protrudes on an underside of the inductive component and a take-up area protrudes laterally from the inductive component.

13. The inductive component according to claim 1, wherein the exterior flange includes a reinforcement in an area of transition to the contact strips.

14. An apparatus comprising:

a circuit board; and an inductive component mounted on the circuit board, the inductive component comprising:

a coil body comprised of an exterior flange and a winding tube;

a contact strip on the exterior flange, the contact strip having contact elements; and a wire guide slot formed into the contact strip;

wherein (i) in a first region, the wire guide slot is substantially perpendicular to the exterior flange, and (ii) in a second region, the wire guide slot is angled toward the winding tube.

15. An inductive electrical component comprising:

a coil body having a coil space;

a contact strip having contact elements; and a wire guide slot formed into the contact strip;

wherein (i) in a first region, the wire guide slot is substantially perpendicular to a longitudinal axis of the coil body, and (ii) in a second region, the wire guide slot is angled in a direction of the coil space relative to the longitudinal axis.

16. The inductive electrical component of claim 15, wherein a portion of the second region is substantially parallel to a portion of the first region.

17. The inductive electrical component of claim 15, further comprising a reinforcement structure disposed between the coil body and the contact strip.

18. The inductive electrical component of claim 15, wherein the wire guide slot has a cross section that is one of rectangular, trapezoidal, and oval.

19. The inductive electrical component of claim 15, wherein the direction of the coil space comprises a direction that is away from a surface of the contact strip that comes into contact with a circuit board.

20. The inductive electrical component of claim 15, further comprising a second wire guide slot which is angled differently in a direction of the coil space.

* * * * *